US007305956B2

(12) United States Patent
Thomas et al.

(10) Patent No.: US 7,305,956 B2
(45) Date of Patent: Dec. 11, 2007

(54) DEVICE FOR USE IN STARTING A MODEL AIRPLANE ENGINE

(76) Inventors: Edmund R Thomas, 15725 Old Mission Dr., Red Bluff, CA (US) 96080; Joan A. Thomas, 15725 Old Mission Dr., Red Bluff, CA (US) 96080

( * ) Notice: Subject to any disclaimer, the term of this patent is extended or adjusted under 35 U.S.C. 154(b) by 35 days.

(21) Appl. No.: 11/405,785

(22) Filed: Apr. 18, 2006

(65) Prior Publication Data

US 2007/0240664 A1 Oct. 18, 2007

(51) Int. Cl.
*F02N 11/12* (2006.01)

(52) U.S. Cl. ..... 123/179.27

(58) Field of Classification Search ..... 123/DIG. 3, 123/179.27, 179.25
See application file for complete search history.

(56) References Cited

U.S. PATENT DOCUMENTS

| | | | | |
|---|---|---|---|---|
| 1,417,508 | A * | 5/1922 | Foster | 123/179.27 |
| D139,314 | S | 10/1944 | Lyman | |
| 2,385,963 | A * | 10/1945 | Beard | 123/179.27 |
| D145,407 | S | 8/1946 | Miller | |
| 3,190,276 | A * | 6/1965 | Diggs | 123/179.27 |
| 4,363,604 | A | 12/1982 | Broberg, Jr. | |
| 5,407,151 | A | 4/1995 | Singhal | |
| 5,535,713 | A | 7/1996 | Braddock | |
| 6,085,711 | A | 7/2000 | Gerst | |
| 6,655,336 | B2 * | 12/2003 | Arlton | 123/179.27 |
| 6,837,202 | B1 | 1/2005 | Lu | |
| 6,968,821 | B2 | 11/2005 | Otsuki | |

* cited by examiner

*Primary Examiner*—Stephen K. Cronin
*Assistant Examiner*—Arnold Castro
(74) *Attorney, Agent, or Firm*—Raymond M. Galasso; Galasso & Associates LP

(57) ABSTRACT

A device for starting a model airplane engine from a starter motor, electric drill or other drive means. The device for starting a model airplane engine comprises a cylindrical hub having an open end and a closed end, the hub having tubular sidewalls attached to periphery edges of the base and extending towards the open end of the hub. The tubular sidewall is provided with two slots. The slots are positioned diametrically opposed across the axis of revolution of the hub. A substantially flat bumper bracket extends outwards from the hub through the slots. The bumper bracket is equipped with elongated side bumpers attached at opposing ends of the bracket, the side bumpers extending forward from the hub and adapted to interface with and torsionally drive a model airplane propeller. The starting device transferring rotary torque from the drive means to the airplane propeller and engine to crank the engine and thereby facilitate starting of the engine.

7 Claims, 4 Drawing Sheets

DEVICE FOR USE IN STARTING A MODEL AIRPLANE ENGINE

FIELD OF THE DISCLOSURE

The disclosures made herein relate generally to the field of model airplanes designed for powered flight, and to gas engines for powering model airplanes, and more particularly to devices to be used in starting a model airplane engine. Even more particularly the disclosures herein relate to devices which are designed to interface between the propeller of a gas powered model airplane and a motorized device for cranking and starting a model aircraft gas engine, thereby eliminating hand starting.

BACKGROUND

Model airplanes built for flight including radio controlled model airplanes are typically equipped with small gas engines to propel the aircraft. These engines are typically started by hand, that is using the fingers to spin the propeller and the connected engine crankshaft until the model airplane engine catches and runs independently. A typical way of accomplishing this is by holding the model aircraft in one hand and then using the free hand to spin the propeller, thereby mechanically operating the engine until the engine catches. A serious limitation of this method of starting the model plane engine is that the person starting the plane may have fingers, hand, face, forearm and possibly hair and clothing near or in potential contact with the aircraft propeller. When the task succeeds and the engine eventually comes to life, the spinning propeller can inflict serious injury to the person starting the engine. Typical model airplane engines operate in the vicinity of 10,000 to 25,000 revolutions per minute, and so the risk of bodily injury to a person having parts of the body in or near the path of a spinning propeller is quite substantial. Larger gas model engines make the task of hand starting even more difficult due to the increased torque required to crank the engine, together with the higher torques achieved by the larger engines in operation and therefore increased risk of bodily injury from a spinning propeller when starting the engine.

In starting a model aircraft engine it is advantageous to spin the engine at higher revolutions per minute (RPMs) than can be readily achieved by hand cranking the engine. Spinning the engine at higher RPMs can provide a hotter spark to the spark plug or glow plug while at the same time more quickly clearing a possible flooded condition, which is quite difficult to clear by hand cranking alone.

Hand-held electrically powered starter motors designed for use in starting model airplane engines are commonly available from a number of manufacturers. Typically electric starters are powered from a convenient and portable 12V DC power source such as a car battery or the smaller lawn tractor or motor cycle battery. Such starters are often equipped with a rubber boot on the end of the starter drive shaft. The rubber boot is designed to press against the cone cap of the propeller and thereby transmitting the rotary torque of the starter to the plane propeller and gas engine. This rubber boot method of coupling the starter to the model engine is workable, however, it may require an undesirable amount of force to be applied to the airplane propeller cone cap and model to achieve sufficient frictional coupling to transmit enough torque to spin the model airplane engine for starting. Not all model airplanes are equipped with propeller cone caps, some have a bolted on propeller and in such cases the rubber drive boot on the electric starter may not be sufficient to crank and start the model engine.

Therefore, a device which is designed to interface a variety of model airplane starters to a model airplane, which improves the mechanical torque transfer coupling between the starter and the airplane propeller and engine allowing sufficient starting torque to be delivered to the gas engine from the starter, a device that overcomes the slippage and limited torque transmission capabilities of the prior art starter coupling methods, that further reduces the need for hand starting and improves operator safety by removing hands, fingers, clothing from the vicinity of the model aircraft engine during starting, such a device for use in starting a model airplane engine would be useful and novel.

SUMMARY OF THE DISCLOSURE

Accordingly, embodiments of the inventive disclosures made herein comprise devices for use in starting various sizes and types of model airplane engines, that when applied in conjunction with appropriate motorized drive means simplifies the task of starting a model aircraft engine.

In a first and at least one embodiment of the inventive disclosures made herein, the model airplane engine starting device comprises a cylindrical hub having an open end, and a closed end having a hub base, the hub further having tubular sidewalls joined to periphery edges of the base and extending towards the open end of the hub. The tubular sidewall of the hub is provided with two slots diametrically opposed across the axis of revolution of the hub. An adapter flange for interfacing with a drive means is secured to the backside of the hub base. The adapter flange comprises a top end secured to the bottom portion of the hub base, a driven end distally spaced from the flange top end, and a flange body attached to and spanning between the driven end and the top end. The flange body is additionally provided with two or more opposing driven faces, the driven faces sized and adapted to receive a rotary torque drive from a drive means.

Mounted to the base in the hub at the closed end of the hub, and extending through the two slots is a substantially flat elongated bumper bracket having two opposing ends, a top face, a bottom face and a center portion about an axis of symmetry, the bracket received into the two slots in the tubular sidewall, the bracket bottom face secured to the top portion of the hub base substantially such that the axis of symmetry of the bracket aligns with the axis of revolution of the hub. Two elongated propeller side bumpers are secured to the bumper bracket, one at each opposing end of the bracket. Rotary torque from the drive device is transmitted through the hub adapter flange to the hub, then through the bumper bracket to the propeller side bumpers. The side bumpers contact and press against the trailing edges of the propeller applying a twisting torque about the shaft of the propeller and engine and thereby completes the transfer of rotary motion and torque from the power drive device to the model airplane propeller and gas engine.

A pliable circular ring shaped center prop hub donut spacer is provided within the tubular center of the hub and secured to the base of the hub or, in some embodiments, to the bumper bracket. The pliable ring provides a resting pad for the propeller cone cap or propeller bolts while the model airplane starting device of this inventive disclosure has its propeller side bumpers engaged with the propeller in preparation for and while starting the model airplane motor. The hub donut spacer permits the model engine starting device of this inventive disclosure to be used with single nut prop mounts as well as with multi-nut prop mounts. Once the engine has started then the model airplane starting device and the drive means are retracted away from the face of the spinning propeller by the operator, thereby disengaging the model airplane starting device from the propeller and engine.

In another embodiment, the model airplane engine starting device of the first embodiment is modified to have a drive means adapter flange having two drive faces. The flange is sized and adapted to torsionally engage with the drive coupling of commonly used electrically-powered model airplane starter motors, the hub and bumpers transferring the rotary motion torque to the propeller of the model aircraft for starting the model gas engine. One preferred example of an electric drive starter motor for use with the model airplane starting device of the this disclosure is the Sullivan model engine starter, model number S603, as marketed by Sullivan Products of Baltimore, Md., USA. Other available model airplane starter motors are compatible with this embodiment.

In another embodiment, the model airplane engine starting device of the first embodiment is modified to have a drive means adapter flange having six driven connected peripheral faces, the faces forming a hexagonal shaft. The shaft is sized and configured to fit the drive chuck of a standard cordless electric drill, whereby the electric drill can be used to provide rotary torque to the airplane propeller and motor through the model aircraft starting device of the present inventive disclosure. Advantages of this embodiment include the elimination of the need to purchase a separate specialty model airplane starter motor by permitting use of a common cordless drill the model airplane operator may already own.

In one or more embodiments of the inventive disclosures made herein, the model airplane starting device utilizes aluminum for the hub including tubular sidewalls, hub base and flange. The center propeller donut spacer comprises nylon or rubber. The propeller side bumpers preferably comprise nylon, and the bumper bracket comprises nominally ⅛ inch thick flat steel stock. The invention is not limited to the use of the materials outlined herein. This disclosure provided as for additional enablement and as a form of the invention that is presently preferred.

In one or more embodiments of the inventive disclosures herein, the propeller side bumpers are provided with threaded tapped holes in the base of the bumper, and each bumper is attached to the bumper bracket by use of a single #10-32 machine screw. The screws allow the propeller side bumpers to be removed for easy replacement if necessary.

It is an objective of the inventive disclosure made herein to provide a model airplane engine starting device which is designed to eliminate the need for hand cranking of the model plane engine.

It is another objective of the inventive disclosure made herein to provide a model airplane engine starting device which is designed to reduce the chance of serious injury to a person starting the model plane engine by removing hands and fingers from the vicinity of the spinning propeller.

It is yet another objective of the inventive disclosure made herein to provide a model airplane engine starting device which is designed to interface with a variety of commonly available model airplane electric starter motors.

It is another objective of the inventive disclosure made herein to provide a model airplane engine starting device which can be used with a conventional cordless electric drill as the motive power device, thereby eliminating the need for the model plane operator to purchase a separate electric starter and battery.

It is yet another objective of the inventive disclosure made herein to provide a model airplane engine starting device which by design reduces the required front loading pressure between the propeller and a starter motor. The model airplane engine starting device of the present inventive disclosures provided a more positive transmission means of rotational torque to the plane propeller by eliminating common friction type starter to airplane engine drive interfaces.

These and other objects of the invention made herein will become readily apparent upon further review of the following specification and associated drawings.

BRIEF DESCRIPTION OF THE DRAWINGS

The drawings show a form of the invention that is presently preferred; however, the invention is not limited to the precise arrangement shown in the drawings.

DETAILED DESCRIPTION OF THE DRAWINGS

In preparation for explaining the details of the present inventive disclosure, it is to be understood by the reader that the invention is not limited to the presented details of the construction, materials and embodiments as illustrated in the accompanying drawings, as the invention concepts are clearly capable of other embodiments and of being practiced and realized in various ways by applying the disclosure presented herein.

Figure 1:
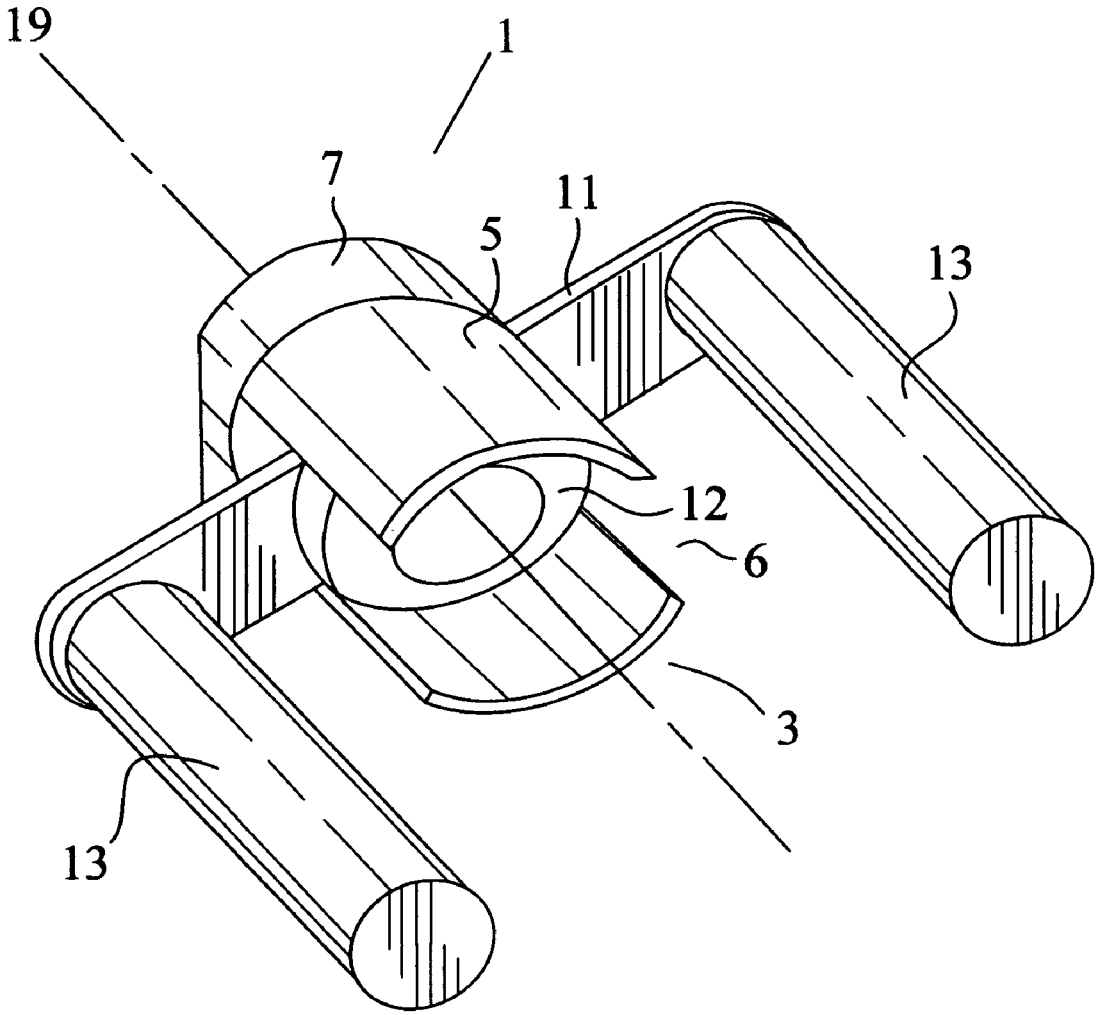
FIG. 1 presents a perspective view of the model plane propeller interface side of one embodiment of a model airplane starting device in accordance with the inventive disclosures herein.
Figure 3:
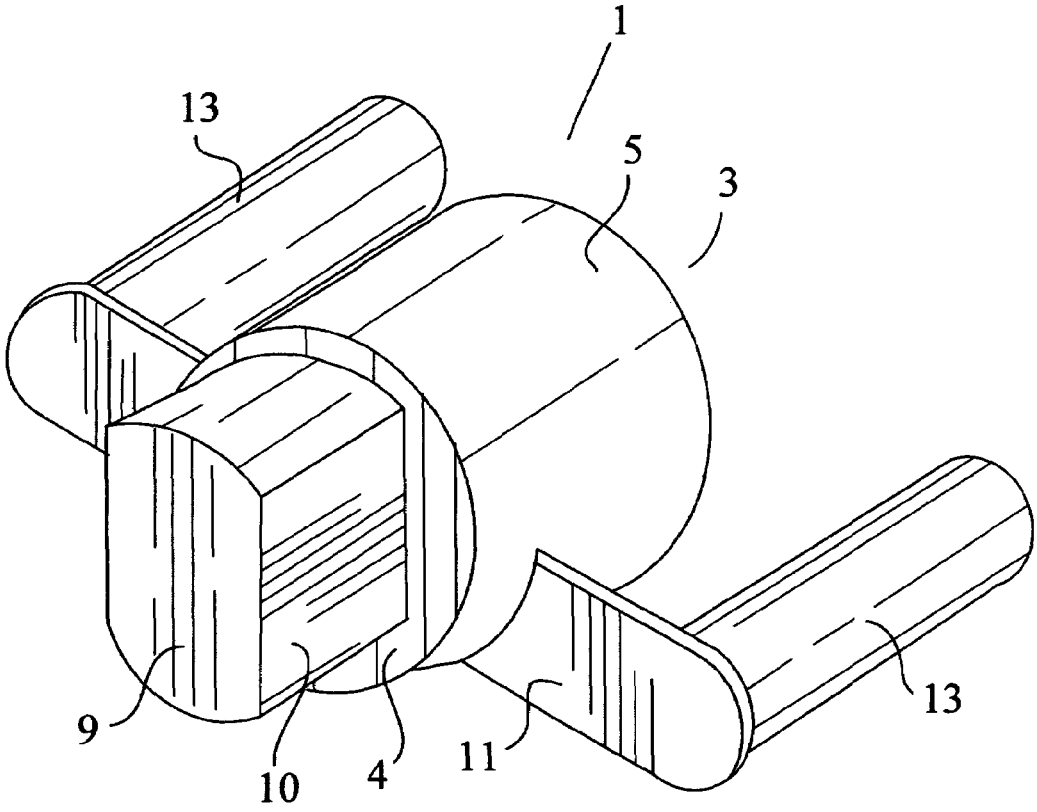
FIG. 3 presents a side view of one embodiment of a model airplane starting device in accordance with the inventive disclosures herein.

Turning now to FIG. 1 and FIG. 3:

FIG. 1 depicts a perspective view of the model plane propeller interface front side of one embodiment of a model airplane starting device in accordance with the inventive disclosures herein. FIG. 3 depicts a perspective view of the driven side of one embodiment of a model airplane starting device in accordance with the inventive disclosures herein.

The model airplane engine starting device 1 comprises a cylindrical hub 2 having an open end 3 and an opposing closed end forming a hub base 4. The hub having a tubular sidewall extending forward from the base, the sidewall secured to peripheral edges of the base. A pair of diametrically opposed slots 6 are formed through the tubular sidewall. A starter unit adapter flange 7 is secured to the back side of the hub base. The adapter flange side secured to the hub being the top end of the flange. The adapter flange having an opposite driven end 9. The adapter flange body is attached to and spanning between the driven end and the top end of the flange. In the depicted embodiment the flange body has two distally spaced flat drive faces 10. The adapter and driven faces are sized and adapted to receive a rotary torque drive from a drive device, for the depicted embodiment the drive device is a conventional model airplane engine hand held electric starter motor. A substantially flat elongated bumper bracket 11 is secured to the hub base and extends through the slots 6 in the tubular sidewall. Two elongated propeller side bumpers 13 are provided, each one secured to an opposing end of the bumper bracket 11. The side bumpers extend outwards from the bumper bracket away from the hub base and, when positioned in front a model airplane for use, towards the model plane propeller. When used for starting the plane engine, the bumpers are engaged against the trailing edge of the model airplane propeller to transfer rotary torque to spin the propeller for engine starting. A pliable circular ring shaped center prop hub donut spacer 12 is placed and secured to the top face of the bumper bracket within the hub, the donut aligned such that the center of the ring substantially aligns with the axis of revolution 19 of the hub, the hub donut spacer adapted to cushion contact between the hub and the propeller or propeller cone cap.

Figure 2:
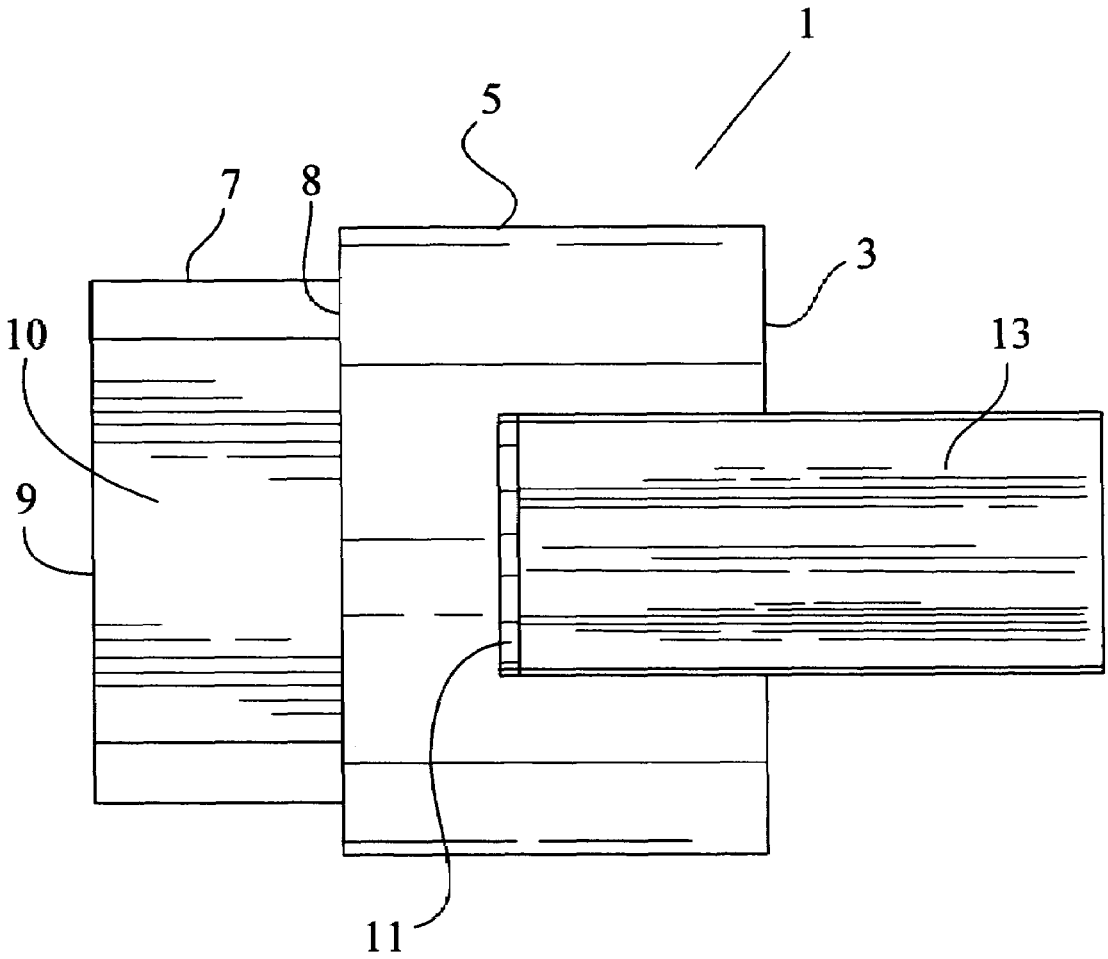
FIG. 2 presents a perspective view of the starting device drive side of one embodiment of a model airplane starting device in accordance with the inventive disclosures herein.

Turning now to FIG. 2:

FIG. 2 depicts a side view of one embodiment of a model airplane starting device in accordance with the inventive disclosures herein. The cylindrical hub having an open end 3, and an opposing end closed by a hub base. The adapter flange 7 having a driven end 9 and a top end 8 secured to the hub base. A substantially flat elongated bumper bracket 111 is secured to the hub base and extends outwards from the tubular sidewall of the hub. Two elongated propeller side bumpers 13 are provided, each one secured at opposite ends of the bumper bracket, the side bumpers extending forward from the hub for interface with the model airplane propeller trailing side edges for delivery of rotary torque to start the airplane engine.

Figure 4:
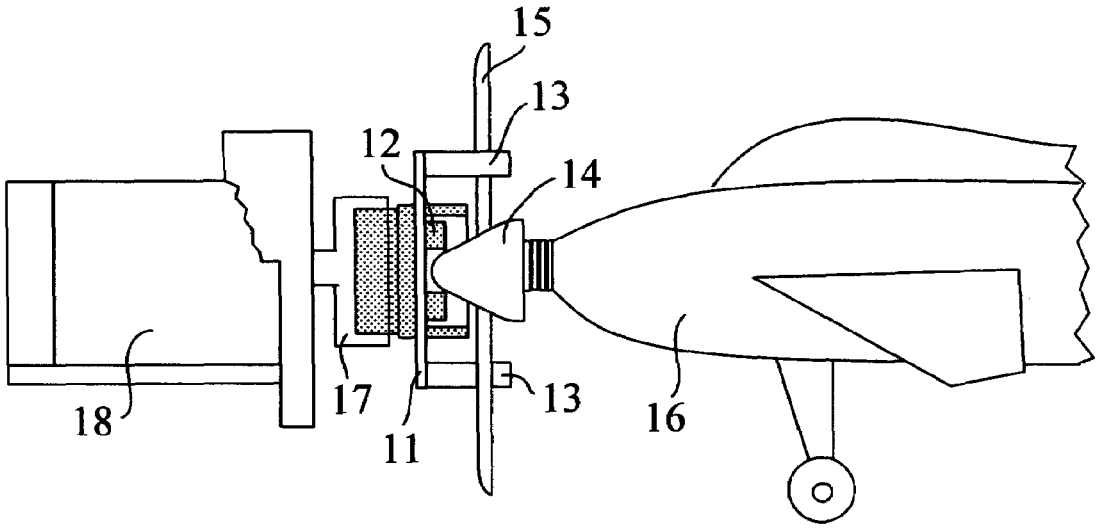
FIG. 4 presents an assembly view of one embodiment of a model airplane starting device in accordance with the inventive disclosures herein, said starting device shown engaged with the propeller of a model plane, and the adapter flange of said starting device torsionally engaged to the drive coupling of the preferred model airplane electric starter as discussed earlier.

Turning now to FIG. 4:

FIG. 4 presents an assembly view of one embodiment of a model airplane starting device 1 in accordance with the inventive disclosures herein together with components required for its use. Said starting device of the present inventive disclosures shown engaged with the propeller 15 of a model plane 16, the adapter flange 7 of said starting device torsionally engaged to the drive coupling 17 of the model airplane electric starter 18. Not shown but to be understood is that in another embodiment the drive means adapter flange body may comprise six driven connected peripheral faces, the faces forming a hexagonal shaft having a maximum diameter between ¼ inch and ⅜ inch, the shaft sized and adapted to be driven by a conventional cordless electric drill. In this case the electric drill replaces electric starter motor and thereby eliminating the need for the electric starter motor and separate starter motor battery.

The discussed construction, illustrations and sequence of operation is for one embodiment of the invention, but is in no way limiting to other embodiments. The operating modes may be changed and enhanced without deviating from the intention of this inventive disclosure.

In the preceding detailed description, reference has been made to the accompanying drawings that form a part hereof, and in which are shown by way of illustration specific embodiments in which the invention may be practiced. These embodiments and certain variants thereof have been described in sufficient detail to enable those skilled in the art to practice the invention. It is to be understood that other suitable embodiments may be utilized and that logical, material, and mechanical changes may be made without departing from the spirit or scope of the invention. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A model airplane engine starting device comprising:

a cylindrical hub having an open end and an opposing closed end hub base, the hub having an axis of revolution, the hub comprising:

a tubular sidewall having two slots, the slots diametrically opposed across the axis of revolution, the sidewall secured to a periphery edge of the hub base;

a starter unit adapter flange, the flange comprising:

a top end secured to the bottom portion of the hub base;

a driven end distally spaced from the flange top end; and a flange body attached to and spanning between the driven end and the top end, the flange body having two or more opposing driven faces, the driven faces sized and adapted to receive a rotary torque drive from a drive means;

a substantially flat elongated bumper bracket having two opposing ends, a top face, a bottom face and a center portion about an axis of symmetry, the bracket received into the two slots in the tubular sidewall, the bracket bottom, face secured to the top portion of the hub base substantially such that the axis of symmetry of the bracket aligns with the axis of revolution of the hub;

a pliable circular ring shaped center prop hub donut, the donut secured within the tubular sidewall to the top face of the bumper bracket, the donut aligned such that a center of the ring substantially aligns with the axis of revolution of the hub, the hub donut adapted to cushion contact between the hub and a propeller; and two elongated propeller side bumpers having two opposing ends, the bumpers secured near opposing ends of the top face of the bumper bracket, one at each opposing end of the bracket; the bumpers extending outwards from the bumper bracket away from the hub base, the bumpers to engage against the trailing edge of a model airplane propeller to transfer rotate torque to spin the propeller for engine starting.

2. The model airplane engine starting device of claim 1, wherein the hub, tubular sidewalls, hub base and flange comprise aluminum;

the bumper bracket comprises steel flat stock;

the center prop hub donut comprises nylon; and the propeller side bumpers comprise nylon.

3. The model airplane engine starting device of claim 2, wherein the drive means is an electric model airplane engine starter.

4. The model airplane engine starting device of claim 1, wherein:

the hub, tubular sidewalls, hub base and flange comprise steel;

the bumper bracket comprises steel flat stock;

the center prop hub donut comprises rubber;

the propeller side bumpers comprise nylon; and the flange body comprises steel, the flange body having six driven connected peripheral faces forming a hexagonal shaft.

5. The model airplane engine starting device of claim 4, wherein the drive means is a cordless electric drill.

6. The model airplane engine starting device of claim 3, wherein:

the bumper bracket comprises ⅛ inch steel flat stock;

the bumper bracket has a length of between 2.5 to 3 inches from end to end; and the cylindrical hub has a diameter of between 1.5 to 2.5 inches.

7. The model airplane engine starting device of claim 5, wherein:

the bumper bracket comprises ⅛ inch steel flat stock;

the bumper bracket has a length of between 2.5 to 3 inches from end to end;

the cylindrical hub has a diameter of between 1.5 to 2.5 inches; and the hub, tubular sidewalls, hub base and flange comprise type 4142 steel.

* * * * *